US005861446A

United States Patent [19]

Ikeoka et al.

[11] Patent Number: 5,861,446

[45] Date of Patent: Jan. 19, 1999

[54] COATED SAND COMPOSITION FOR LIGHT-ALLOY CASTING

[75] Inventors: Yoshiro Ikeoka; Toshisaburo Kimura; Toshitada Onoda, all of Hiroshima-ken, Japan

[73] Assignee: Mazda Motor Corporation, Hiroshima-ken, Japan

[21] Appl. No.: 620,260

[22] Filed: Mar. 22, 1996

[30] Foreign Application Priority Data

Mar. 23, 1995 [JP] Japan ..... 7-063962

[51] Int. Cl.[6] ..... B22C 1/02

[52] U.S. Cl. ..... 523/145; 524/430; 524/432; 524/433; 524/492; 524/493; 524/594; 524/789; 524/876

[58] Field of Search ..... 523/145; 524/430, 524/432, 433, 594, 789, 876, 492, 493

[56] References Cited

FOREIGN PATENT DOCUMENTS 60-15417 4/1985 Japan .
2175044 7/1990 Japan .

OTHER PUBLICATIONS

Ed. Richard Lewis Sr., "Hawley's Condensed Chem. Dict." pp. 1046, 1246–1247, 1993.

*Primary Examiner*—Marion E. McCamish
*Assistant Examiner*—John J. Guarriello
*Attorney, Agent, or Firm*—Sixbey, Friedman, Leedom & Ferguson, P.C.; Gerald J. Ferguson, Jr.; Jeffrey L. Costellia

[57] ABSTRACT

A coated sand composition for light-alloy casting includes refractory particles blended with phenol resin, bromide and adsorbent which adsorbs decomposition product gas from the bromide.

9 Claims, No Drawings

COATED SAND COMPOSITION FOR LIGHT-ALLOY CASTING

BACKGROUND OF THE INVENTION

1. Field of the Invention

This invention relates to a coated sand composition for light alloy casting.

2. Description of the Related Art

When casting a complicated structure such as an engine cylinder head in light alloy such as aluminum alloy, cores and the like are shaped from coated sand, that is, casting sand coated with resin binder, and the cores are used in combination with metal molds. The mold using coated sand must have a strength to withstand casting pressure and at the same time must be well disintegrated after casting. However though being apt to disintegrate in the case of casting in cast iron in which the casting temperature is high and resin burns out during casting, such a mold is not satisfactorily disintegrated in the case of casting in light alloy where the casting temperature is low, which makes troublesome sand removal, especially core removal after casting.

Japanese Unexamined Patent Publication No. 2(1990)-175044 discloses a coated sand composition containing therein bromide of wood material such as lignin bromide as disintegrator. The publication says that the bromide promotes disintegration of the sand mold at low temperature and does not give rise to a problem of metal molds. Further it has been well known to use inorganic bromide as disintegrator as disclosed, for instance, in Japanese Patent Publication No. 60(1985)-15417.

However, though the wood bromide may promote disintegration, such a special compound must be synthesized, which is disadvantageous in reduction of cost. Further whether the bromide is organic or inorganic, the bromide cannot avoid being decomposed by heat during casting and generating bromine gas. The bromine gas causes corrosion of the metal molds. The corroded metal mold requires repeated polishing and padding.

SUMMARY OF THE INVENTION

In view of the foregoing observations and description, the primary object of the present invention is to provide a coated sand composition for light alloy molding which is excellent in disintegration after casting and does not cause corrosion of a metal mold.

In the coated sand composition of the present invention, disintegration of a sand mold is promoted by bromide and corrosion of a metal mold is prevented by converting corrosive gases generated from the bromide to harmless materials.

That is, in accordance with the present invention, there is provided a coated sand composition comprising refractory particles blended with phenol resin, bromide and adsorbent which adsorbs decomposition product gas from the bromide.

The refractory particles may be, for instance, silica sand, and the adsorbent may be, for instance, zinc oxide or soda lime.

The phenol resin serves as a binder for the refractory particles, and the bromide promotes disintegration of the mold shaped from the coated sand. Though the bromide is discomposed and generates a decomposition product gas due to heat during casting, the adsorbent adsorbs the decomposition product gas and prevents corrosion of the metal mold.

As the refractory particles, zircon sand, chromite sand, olivine sand and the like can also be used. The phenol resin which can be employed in the present invention includes novolak phenol resin, resol phenol resin and mixtures of novolak phenol resin and resol phenol resin. Since resol phenol resin is alkaline, use of resol phenol resin is advantageous in preventing corrosion of the metal mold.

Either organic bromide or inorganic bromide may be used as the bromide. For example, tetrabromobisphenol, hexabromobisphenyl ether or the like may be preferably employed as the organic bromide. Bromides of zinc, calcium, ammonium, aluminum, potassium, sodium and the like may be preferably employed as the inorganic bromide.

In one embodiment, the coated sand composition contains therein 1 to 3 parts by weight of phenol resin, 0.01 to 1.0 parts by weight of bromide and 0.01 to 0.1 parts by weight of zinc oxide per 100 parts by weight of refractory particles.

That is, it becomes difficult to obtain desired disintegration of the sand mold when the bromide is less than 0.01 parts by weight and the mold strength becomes too small when the bromide is more than 1.0 part by weight. More preferably the coated sand composition contains bromide in 0.05 to 0.5 parts by weight. When the zinc oxide is less than 0.01 parts by weight, anti-corrosive effect becomes unsatisfactory and when the zinc oxide is more than 0.1 parts by weight, the mold strength becomes too small.

In another embodiment of the present invention, the coated sand composition contains therein 1 to 3 parts by weight of phenol resin, 0.01 to 1.0 parts by weight of bromide and. 0.01 to 0.05 parts by weight of soda lime per 100 parts by weight of refractory particles.

The soda lime increases alkalinity of the binder (phenol resin) for the refractory particles as well as adsorbs the decomposition product gas, thereby preventing corrosion of the metal mold.

When the soda lime is less than 0.01 parts by weight, anti-corrosive effect becomes unsatisfactory and when the soda lime is more than 0.05 parts by weight, the mold strength becomes too small.

DETAILED DESCRIPTION OF THE INVENTION

The present invention will be described in more detail with reference to the following example.

EXAMPLE

Preparation of coated sand

Embodiment 1

10 kg of silica sand heated to 140° C. was introduced into a laboratory speed muller and 69 g of solid novolak phenol resin containing therein 3 g of zinc oxide and 6 g of disintegrator (ECP manufactured by TOYO COATED SAND and containing both organic and inorganic bromides) and 80 g of solid resol phenol resin were added. The mixture was kneaded for 40 seconds. Then stiffener comprising 9 g of hexamine and 150 mL of water was added and after bulk material was broken, 10 g of calcium stearate was further added. After 10 seconds, the mixture was sieved and cooled, whereby coated sand was obtained.

Embodiment 2

10 kg of silica sand heated to 150° C. and 4 g of soda lime ground to not larger than 0.5 mm were introduced into a laboratory speed muller and 120 g of solid novolak phenol resin was added. Then the mixture was kneaded for 25 seconds and then liquid resol phenol resin containing therein 20 g of solid component was added. The mixture obtained was further kneaded for 15 seconds. Then stiffener comprising 18 g of hexamine and 200 mL of water and 16 g of 53% zinc bromide were added and after bulk material was broken, 10 g of calcium stearate was further added. After 10 seconds, the mixture was sieved and cooled, whereby coated sand was obtained.

Control 1

Coated sand was prepared in the manner similar to embodiment 1 except that 146 g of solid novolak phenol resin containing 6 g of disintegrator the same as that used in embodiment 1 (but without zinc oxide) was used and resol phenol resin was not used.

Control 2

Coated sand was prepared in the manner similar to embodiment 1 except that 146 g of solid resol phenol resin containing 6 g of disintegrator the same as that used in embodiment 1 (but without zinc oxide) was used and novolak phenol resin was not used.

Control 3

Coated sand was prepared by using 140 g of novolak phenol resin as the phenol resin and 16 g of 53% zinc bromide as the disintegrator and without adding soda lime.

Evaluation of coated sand

The fusing temperature, the folding endurance, disintegration and generation of corrosion in metal molds were investigated for each coated sand. The fusing temperature was investigated according to JACT test method C-1, and the other performances were investigated in the following manner.

folding endurance

A test piece of ¼"×1"×2" was formed of each coated sand (sintered at mold temperature of 250° C. for 60 seconds). The test piece was loaded at the center thereof with opposite end supported and the load at break of the test piece was measured. The value obtained by dividing the load at break by the cross-sectional area of the test piece was adopted as the folding endurance.

disintegration

A test piece 28 mm in diameter and 50 mm in length was formed of each coated sand. The test piece was wrapped with aluminum foil and heated for 8 minutes in an oven at 700° C. After cooling, the aluminum foil was removed and the weight of the test piece was measured. Then the test piece was put on a 20 mesh sieve and vibrated for 30 seconds by a jet shifter. The amount of the disintegrated part of the test piece was thereafter measured and the percentage of the amount of the disintegrated part to the original weight was adopted as the integration.

corrosion in metal molds

A test piece which was 28 mm in diameter and 50 mm in length and inserted with a grease-free washer at an intermediate part thereof was formed of each coated sand. The test piece was subjected to the same heat treatment as in the disintegration test and then the washer was taken out. The amount of corrosion on the surface of the washer was visually inspected and evaluated on the basis of 10 points.

Result of the test is shown in table 1. In table 1, the compositions are in parts by weight.

| | emb. 1 | cont. 1 | cont. 2 | emb. 2 | cont. 3 |
|---|---|---|---|---|---|
| silica sand | 100 | 100 | 100 | 100 | 100 |
| phenol resin | | | | | |
| novolak | 0.6 | 1.4 | 0 | 1.2 | 1.4 |
| resol | 0.8 | 0 | 1.4 | 0.2 | 0 |
| disintegrator | | | | | |
| ECP | 0.06 | 0.06 | 0.06 | 0 | 0 |
| $ZnBr_2$ | 0 | 0 | 0 | 0.16 | 0.16 |
| zinc oxide | 0.03 | 0 | 0 | 0 | 0 |
| soda lime | 0 | 0 | 0 | 0.04 | 0 |
| fusing temperature (°C.) | 105 | 109 | 103 | 102 | 95 |
| folding endurance (Kg/cm$^2$) | 34.6 | 32.5 | 35.4 | 30.1 | 32.9 |
| disintegration (%) | 68.0 | 47.1 | 59.2 | 71.4 | 53.4 |
| corrosion prevention | 9 | 1 | 3 | 8 | 1 |

As can be understood from table 1, the fusing temperature less depends upon existence of zinc oxide or soda lime.

Though the folding endurance less depends upon existence of zinc oxide or soda lime in table 1, actually the folding endurance is weakened when the amount of zinc oxide or soda lime is excessive.

As for the disintegration, the embodiments 1 and 2 are better than the corresponding controls (more apt to disintegrate). Though the reason is not clear, it may be said that zinc oxide and soda lime do not deteriorate the effect of disintegrator (ECP or zinc bromide) and the result of the test shows that zinc oxide and soda lime assisted the disintegrator.

As for the corrosion in metal molds, generation of corrosion was remarkable in the coated sands of controls 1 and 3 in which acidic novolak phenol resin was used, and generation of corrosion is observed in the coated sand of control 2 in which only alkaline resol phenol resin was used. To the contrast, generation of corrosion was hardly observed in the coated sand of embodiment 1 in which zinc oxide was added. Accordingly it may be said that zinc oxide adsorbed bromine gas and prevented generation of corrosion.

Further generation of corrosion was very small in the coated sand of embodiment 2 in which soda lime was added, which showed that soda lime is effective in preventing generation of corrosion. It is considered that soda lime prevents generation of corrosion not only by alkalifying the coated sand but also by adsorbing bromine gas. This is because generation of corrosion was observed also in the coated sand of control 2 where the coated sand was alkaline and generation of corrosion was much less in embodiment 2 than in control 2.

As can be understood from the description above, addition of adsorbent such as zinc oxide or soda lime prevents generation of corrosion in metal molds without deteriorating mold strength. Further such adsorbent does not deteriorate the mold disintegrating effect of bromide; rather it promote the mold disintegrating effect of bromide.

What is claimed is:

1. A coated sand composition for light-alloy casting comprising:

refractory particles blended with phenol resin, a bromide compound and adsorbent, wherein said adsorbent adsorbs decomposition produced gas from the bromide compound, wherein said composition includes 0.01 to 0.1 parts by weight of adsorbent.

2. A coated sand composition as defined in claim 1 in which the refractory particles are silica sand.

3. A coated sand composition as defined in claim 1 in which the phenol resin includes resol phenol resin.

4. A coated sand composition as defined in claim 1 in which the adsorbent is zinc oxide.

5. A coated sand composition as defined in claim 4 comprising 100 parts by weight of refractory particles, 1 to 3 parts by weight of phenol resin, 0.01 to 1.0 parts by weight of bromide compound and 0.01 to 0.1 parts by weight of zinc oxide.

6. A coated sand composition as defined in claim 1 in which the adsorbent is soda lime.

7. A coated sand composition as defined in claim 6 comprising 100 parts by weight of refractory particles, 1 to 3 parts by weight of phenol resin, 0.01 to 1.0 parts by weight of bromide compound and 0.01 to 0.05 parts by weight of soda lime.

8. A coated sand composition as defined in claim 1, wherein said adsorbent is zinc oxide or soda lime and said coated sand is used in combination with a metal mold.

9. A coated sand composition as defined in claim 6, comprising 0.01 to 0.05 by weight of adsorbent, wherein said adsorbent is soda lime.

* * * * *